United States Patent [19]

Fernandez et al.

[11] 4,123,769

[45] Oct. 31, 1978

[54] WASHING CHAMBER FOR PHOTOGRAPHIC DEVELOPING APPARATUS

[75] Inventors: Avelino Fernandez, Gauting; Josef Glass, Ottobrunn; Viktor Osegowitsch, Taufkirchen; Wilfried Hehn, Muenchen, Kleinhadern, all of Fed. Rep. of Germany

[73] Assignee: Agfa-Gevaert AG, Leverkusen, Fed. Rep. of Germany

[21] Appl. No.: 796,881

[22] Filed: May 16, 1977

[30] Foreign Application Priority Data

May 26, 1976 [DE] Fed. Rep. of Germany ..... 2623702

[51] Int. Cl.[2] ..... G03D 3/08

[52] U.S. Cl. ..... 354/322; 354/325; 118/423; 134/64 P

[58] Field of Search ..... 354/319, 320, 321, 322, 354/325, 338, 339, 317, 318, 316; 134/64 R, 64 P, 122 P; 355/15; 118/126, 304, 419, 423; 15/93 R, 100, 102

[56] References Cited

U.S. PATENT DOCUMENTS

| | | | |
|---|---|---|---|
| 3,242,843 | 3/1966 | Tillotson et al. | 354/338 |
| 3,566,831 | 3/1971 | Herman | 118/304 |
| 3,589,261 | 6/1971 | Krikelis | 354/322 |
| 3,640,617 | 2/1972 | Fredrickson et al. | 355/15 |
| 3,733,992 | 5/1973 | Stievenart et al. | 134/122 P |
| 3,735,689 | 5/1973 | Smola et al. | 134/122 P |
| 3,833,918 | 9/1974 | Stievenart et al. | 354/339 |
| 3,995,585 | 12/1976 | Schuurmans | 354/318 |
| 3,999,511 | 12/1976 | Schwandt | 354/318 |

*Primary Examiner*—L. T. Hix
*Assistant Examiner*—Alan Mathews
*Attorney, Agent, or Firm*—Michael J. Striker

[57] ABSTRACT

The developing apparatus includes a plurality of successive processing chambers arranged for generally horizontal travel of a photographic material to be developed through the successive processing chambers. Each processing chamber is provided with a processing-fluid tank and guide structure for guiding the photographic material through the processing chamber. Transport roller pairs are arranged intermediate adjoining processing chambers for transporting photographic material from one chamber to the next. The last processing chamber is a washing chamber. The washing chamber includes a wash-water tank containing a body of wash water, with the upper surface of the body of wash water being maintained at a predetermined level. The washing chamber includes a guide structure for guiding photographic material through the washing chamber, including a submerging structure for causing transported photographic material to pass below the upper surface of the body of wash water. A pair of outfeed rollers, constituting transport rollers and/or squeeze-off rollers, is provided at the outlet end of the washing chamber for outfeed of washed photographic material. One roller is located above the other. A spray pipe is located intermediate the submerging structure and the outfeed rollers and is provided with a plurality of spray outlets oriented for spraying the wash water onto the peripheral surface of the upper one of the outfeed rollers.

6 Claims, 2 Drawing Figures

WASHING CHAMBER FOR PHOTOGRAPHIC DEVELOPING APPARATUS

BACKGROUND OF THE INVENTION

The invention relates to developing apparatuses of the type comprised of a plurality of successive processing chambers arranged for generally horizontal travel of a photographic material, particularly in sheet form, through the successive processing chambers. Each processing chamber is provided with a processing-fluid tank and guide means for guiding the photographic material through the processing chamber. Transport roller pairs are arranged intermediate adjoining processing chambers for transporting photographic material from one chamber to the next. The last processing chamber is a washing chamber.

Developing apparatuses of this type are usually employed for the development of X-ray film and black-white paper. Known apparatuses of this type are of such construction and design that the washing chamber cannot be larger than the preceding processing chamber. Accordingly, if photographic material is being transported through the successive chambers at a certain rate, the dwell time of photographic material within the washing chamber is correspondingly predetermined.

With these known apparatuses, at normal operating speeds, the dwell time of the photographic material in the washing chamber is sufficient for X-ray film and black-white paper. However, it is too short for color paper, thereby precluding the development of color paper in such an apparatus.

SUMMARY OF THE INVENTION

It is a general object of the invention to provide, in a developing apparatus of the type in question, a novel construction and operation for the washing chamber, such that if the apparatus should also be used for developing color paper the washing operation in the washing chamber will be completely adequate.

This object can be met, according to one concept of the invention, by designing the washing chamber to include a wash-water tank containing a body of wash water with the upper surface of the body of wash water maintained at a predetermined level, guide means for guiding photographic material through the washing chamber, including submerging means for causing transported photographic material to pass below the upper surface of the body of wash water during its travel through the washing chamber, a pair of outfeed rollers at the outlet end of the washing chamber for outfeed of washed photographic material, one roller being arranged above the other, and a spray pipe located intermediate the submerging means and the outfeed rollers and provided with a plurality of spray outlets oriented for spraying wash water onto the peripheral surface of the upper one of the pair of outfeed rollers.

The washing action which can be achieved with such a construction is so effective as to permit use of the developing apparatus in question for the development of color paper. Furthermore, it becomes possible to use ordinary tap water for the washing water, and the need for tempered washing water is eliminated. Furthermore, the washing action is such that the amount of water consumed is relatively low.

The excellent washing action is to a considerable extent attributable to the fact that the photographic material is first submerged below the upper surface of the body of wash water and accordingly soaked therein, after which it is subjected to an auxiliary washing operation in which it is sprayed with fresh wash water.

The spraying of the fresh wash water onto the peripheral surface of the upper outfeed roller results in very uniform distribution of this water, avoiding striplike washing effects on the surface of the photographic material.

According to another concept of the invention, a second spray pipe is located in the vicinity of the submerging means and is provided with at least one spray outlet. Wash water is sprayed through this outlet onto a deflecting vane. The sprayed water is deflected along the surface of the deflecting vane towards the upper surface of the body of wash water at a location near the midpoint between the inlet and outlet ends of the wash water. Advantageously, the sprayed water deflected along the surface of the deflecting vane enters into the body of wash water at the upper surface of the latter and in generally horizontal direction. As a result, the processing chemicals rinsed off the photographic material where the latter is submerged into the body of wash water, and accumulating at the bottom of the wash water tank, can be readily elutriated. The infeed of wash water via this deflecting vane produces a transport of such chemicals to the outflow structure of the wash-water tank.

The outflow structure of the wash-water tank is so designed that there will be selective or preferential outflow of washed-off chemicals through the outflow structure. Specifically, it will be the washed-off chemicals accumulating at the bottom of the wash-water tank which are most directly removed from the interior of the tank.

Advantageously, all points of introduction of fresh wash water into the washing chamber are located at least 2 cm above the highest level which the body of wash water in the wash-water tank can assume. This assures compliance with local ordinances, if any, concerning the possibility of chemically polluted water entering into tap-water lines.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
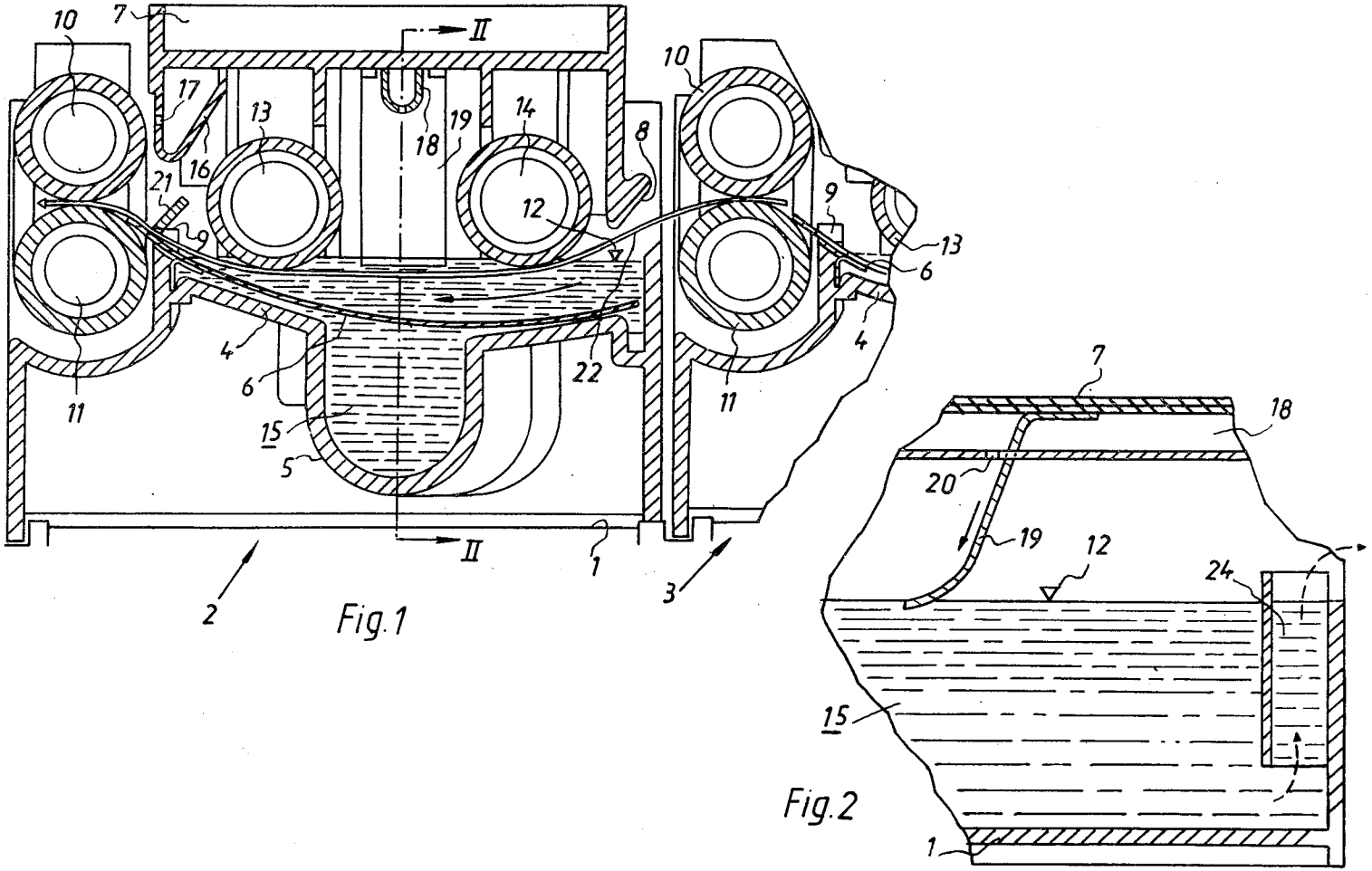
FIG. 1 is a sectional view through a part of the type of developing apparatus in question.
FIG. 2 is a sectional view through the structure shown in FIG. 1, taken on section line II—II of FIG. 1.

In FIG. 1, numeral 1 denotes the structural framework of the plurality of processing chambers of a developing apparatus of the type in question. Of these chambers, there is depicted in FIG. 1 only the washing chamber 2 and a part of the preceding processing chamber 3. The construction of all of the developing chambers is very similar, so that only the construction of washing chamber 2 need be described in detail.

Preferably mounted directly upon the structural framework 1 is a structure forming a wash-water tank 4, provided in its middle part with a portion 5 of greater depth. The wash-water tank 4 is closed off at its top by an upper structure 7, designed to leave clearances at the infeed and outfeed ends of the washing chamber 2 serving as an infeed slot 8 and an outfeed slot 9, respectively. The infeed slot 8 of the washing chamber 2 directly adjoins the transport path of photographic material through the preceding chamber 3, whereas the outfeed slot 9 is located just upstream of two outfeed rollers 10 and 11. The outfeed rollers 10 and 11 may be positively driven transport rollers, and additionally may have their outer surfaces so designed and of such a material that they simultaneously serve as squeeze-off rollers.

A guide member 6 extends through the wash-water tank 4 located below the upper surface 12 of the wash water 15 therein. It extends from the vicinity of the infeed slot 8 to the outfeed slot 9 and may, as here, extend past the outfeed slot 9. The guide means for guiding transported photographic material 22 also includes submerging rollers 13 mounted dependently from the upper structure 7 and partially submerged below the upper surface 12 of the wash water 15 in tank 4. These rollers cause transported photographic material 22 to pass beneath the upper surface 12 of the wash water 15 in tank 4, during the major part of the transport of such material through the washing chamber 2.

Formed integral with the upper structure 7 is a spray pipe 7 which extends in the direction parallel to the axes of outfeed rollers 10, 11. At one end, the spray pipe 16 is connected to a (non-illustrated) fresh wash water pipe. Spray pipe 16 is provided with spray outlets 17 oriented to spray fresh wash water upon the peripheral surface of the upper outfeed roller 10.

Located in the vicinity where the photographic material 22 is submerged is a second spray pipe 18 which, like first spray pipe 16, extends transverse to the transport direction of material 22 and is connected to a (non-illustrated) fresh wash water pipe. Second spray pipe 16 is preferably formed integral with upper structure 7. Cooperating with the spray pipe 18 is a deflecting vane 19, whose upper end is secured to upper structure 7 (see FIG. 2). The configuration of deflecting vane 19 is such that fresh wash water from spray pipe 18 is sprayed through a spray outlet 20 of the latter onto the upper portion of the deflecting vane 19, and is deflected along the surface of the latter into the wash water 15, entering the body of wash water 15 in generally horizontal direction. The lower end of vane 19 is somewhat curved, dips slightly into the wash water 15 and ends generally horizontally. The discharge end of vane 19 accordingly discharges fresh wash water from spray pipe 18 into the body of wash water 15 at the middle portion of the latter, and in a direction transverse to the transport direction of photographic material 22.

In the illustrated construction, a stripping lip structure 21 is located in the outfeed slot 9.

As shown in FIG. 2, the outflow structure 24 of the tank 4 is so designed as to preferentially or selectively effect removal of the fluid at the bottom of the tank. The outflow outlet proper of outflow structure 24 may be a simple overflow outlet. Thus, processing chemicals washed off the submerged photographic material 22 and tending to accumulate at the bottom of the tank 4 will be preferentially or selectively removed from the tank 4.

The operation of the exemplary washing chamber depicted in FIGS. 1 and 2 is as follows:

The transport roller pair 10, 11 of the processing chamber 3 transports photographic material 22 from chamber 3 into the infeed slot 8 of washing chamber 2 (leftward, as indicated by the arrow). Due to the configuration of the infeed slot 8, the infed photographic material 22 is deflected downward to below the submerging rollers 14 and 13, and is caused by the latter to travel through the wash water bath 15 at a level below the upper surface 12 thereof. The guide member 6 serves to assure that as the sheet 22 of photographic material is transported further it will be fed through the outfeed slot 9 and enter between the outfeed transport or squeeze-off rollers 10 and 11.

In the illustrated construction, the photographic material 22 if in sheet form must have a length at least as great as the transport-path length from one pair of rollers 10, 11 to the next.

Fresh wash water is sprayed from spray pipe 16 through the spray outlets 17 thereof onto the peripheral surface of the upper outfeed roller 10. This sprayed water becomes very uniformly distributed upon the peripheral surface of roller 10 and is fed onto the photographic material 22 as a very uniform film.

The stripping lip structure 21 located at the outfeed slot 9 serves to strip from the transported photographic material 22 the contaminated wash water adhering thereto after emergence of material 22 from below the upper surface 12 of wash water bath 15. This increases the effectiveness of the fresh wash water being sprayed from spray pipe 16 and applied to the sheet 22 by the roller 10. The stripping lip structure 21 is preferably elastically resilient. It forms together with the photographic material 22 itself a flow-off channel for the fresh wash water from spray pipe 16, so that this water will not run-off too quickly, but instead remain in contact with the surface of material 22 downstream of stripping lip 21 for a certain amount of time during its run-off. In general, the wider the photographic material 22, the more difficult would have been the establishment of a uniform distribution of wash water, and accordingly, of a satisfactory washing effect.

Fresh water is sprayed from the spray outlet(s) 20 of the second spray pipe 18 onto the deflecting vane 19, and flows into the wash water bath 15 generally tangential to the upper surface 12 thereof. This manner of introducing wash water produces a very considerable agitation in the middle portion of the wash-water tank. As a result, the removal of washed-off processing chemicals (such as sodium thiosulfate or Bro 1070) settling to the bottom of the tank through the outflow structure 24 is very considerably improved.

Utilizing the inventive expedients described above, washing of color paper in the type of developing apparatus in question is satisfactorily accomplished even if the transport time of the paper through the washing chamber is as short as about 70 seconds.

It will be understood that each of the elements described above, or two or more together, may also find a useful application in other types of constructions differing from the types described above.

While the invention has been illustrated and described as embodied in a developing apparatus for processing sheets of photographic material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In a developing apparatus of the type comprised of a plurality of successive processing chambers arranged for generally horizontal travel of a photographic material to be developed through the successive processing chambers, with each processing chamber being provided with a processing-fluid tank and guide means for guiding photographic material through the processing chamber, and with transport roller pairs being provided intermediate adjoining processing chambers for transporting photographic material from one chamber to the next, with the last processing chamber being a washing chamber, a washing chamber of novel construction comprising a wash-water tank containing a body of wash water with the upper surface of the body of wash water maintained at a predetermined level; guide means for guiding photographic material through the washing chamber, including submerging means for causing transported photographic material to pass below the upper surface of the body of wash water; a pair of outfeed rollers at the outlet end of the washing chamber for outfeed of washed photographic material, one roller being arranged above the other; and a spray pipe located intermediate the submerging means and the outfeed rollers and provided with a plurality of spray outlets oriented for spraying wash water onto the peripheral surface of the upper one of the pair of outfeed rollers.

2. The developing apparatus defined in claim 1, further including a second spray pipe located in the region of the submerging means and provided with at least one spray outlet for downward discharge of spray water, and a deflecting vane mounted in the washing chamber, the orientations of the at least one spray outlet of the second spray pipe and of the deflecting vane being such that wash water is sprayed out the former onto the latter and deflected along the deflecting vane to the middle of the body of wash water.

3. The developing apparatus defined in claim 2, the deflecting vane having an upper end mounted in the washing chamber and a lower end so configured as to extend generally horizontally into the upper surface of the body of wash water.

4. The developing apparatus defined in claim 2, the washing chamber including an upper part, the two spray pipes and the upper part being integral with one another.

5. The developing apparatus defined in claim 1, further including a stripping lip structure located in the vicinity of the pair of outfeed rollers upstream thereof, the stripping lip structure extending in the axial direction of the rollers over the full length of the upper roller and operative for stripping contaminated wash water off the surface of photographic material being transported towards the outfeed rollers.

6. The developing apparatus defined in claim 5, the guide means being operative for establishing a path of transport for photographic material transported through the washing chamber such that the transported photographic material in conjunction with the stripping lip structure forms a channel for the wash water sprayed onto and running off the upper outfeed roller.

* * * * *